US009662251B2

(12) United States Patent
Fertig et al.

(10) Patent No.: US 9,662,251 B2
(45) Date of Patent: May 30, 2017

(54) ALL-TERRAIN WHEELCHAIR

(71) Applicants: Christopher William Fertig, Virginia Beach, VA (US); William Joseph Fertig, Virginia Beach, VA (US); Noreen Fertig, Virginia Beach, VA (US)

(72) Inventors: Christopher William Fertig, Virginia Beach, VA (US); William Joseph Fertig, Virginia Beach, VA (US); Noreen Fertig, Virginia Beach, VA (US)

( * ) Notice: Subject to any disclaimer, the term of this patent is extended or adjusted under 35 U.S.C. 154(b) by 0 days.

(21) Appl. No.: 14/523,822

(22) Filed: Oct. 24, 2014

(65) Prior Publication Data

US 2015/0115566 A1 Apr. 30, 2015

Related U.S. Application Data

(60) Provisional application No. 61/895,780, filed on Oct. 25, 2013.

(51) Int. Cl.

| | |
|---|---|
| ***A61G 5/10*** | (2006.01) |
| ***A61G 5/06*** | (2006.01) |
| ***A61G 5/12*** | (2006.01) |

(52) U.S. Cl.

CPC ..... *A61G 5/06* (2013.01); *A61G 5/101* (2013.01); *A61G 5/1027* (2013.01); *A61G 5/1035* (2013.01); *A61G 5/125* (2016.11); *A61G 5/128* (2016.11)

(58) Field of Classification Search

CPC .. A61G 5/06; A61G 2005/0875; A61G 5/104; A61G 2005/1083

See application file for complete search history.

(56) References Cited

U.S. PATENT DOCUMENTS

| | | | | |
|---|---|---|---|---|
| 4,405,142 | A * | 9/1983 | Whetstine | A61G 5/00 16/19 |
| 4,666,170 | A * | 5/1987 | Vasa | A61G 5/06 280/291 |
| 4,695,072 | A * | 9/1987 | Brooks | A61G 1/013 280/47.25 |
| 4,892,323 | A * | 1/1990 | Oxford | A61G 5/023 105/129 |

(Continued)

*Primary Examiner* — Katy M Ebner

(74) *Attorney, Agent, or Firm* — The Olmsted Law Group, PLLC; Andrew Olmsted

(57) ABSTRACT

An all-terrain wheelchair includes a rigid and easy-to-assemble frame. The frame has a seating area with armrests toward the rear of the frame and an adjustable footrest area toward the front of the frame. Attached to the rear axle of the frame and outside the seating area are found two large rear wheels of a sufficient width to provide flotation over soft surfaces. Attached to the front axle of the frame in front of the footrest area is a single large wheel of a sufficient width to provide flotation over soft surfaces. An ergonomically designed push handle is found at the upper rear of the frame behind the seating area, which allows an assistant to propel the chair forward or pull it backward. The frame in front of the front wheel forms a pull handle, which allows an assistant to pull the chair forward or push it backward. A locking brake mechanism is attached to the rear axle to prevent a rear wheel from travel and render the wheelchair motionless when necessary.

6 Claims, 6 Drawing Sheets

(56) References Cited

U.S. PATENT DOCUMENTS

| | | | | | |
|---|---|---|---|---|---|
| 5,149,118 | A * | 9/1992 | Oxford | A61G 5/023 | 280/250.1 |
| 5,507,513 | A * | 4/1996 | Peters | A61G 5/00 | 280/250.1 |
| 5,518,081 | A * | 5/1996 | Thibodeau | B62K 5/025 | 180/210 |
| 5,624,128 | A * | 4/1997 | Owens | A61G 5/00 | 280/1.5 |
| 5,634,650 | A * | 6/1997 | Hensler, Sr. | A61G 5/00 | 280/250.1 |
| 6,736,417 | B1 * | 5/2004 | Whitmire | A61G 1/017 | 280/47.3 |
| 6,869,084 | B2 * | 3/2005 | Volk | A61G 5/08 | 16/18 B |
| 6,902,177 | B2 * | 6/2005 | Lindsay | A61G 5/023 | 280/282 |
| 7,192,043 | B1 * | 3/2007 | McLuen | A61G 5/08 | 280/250.1 |
| 8,585,071 | B2 * | 11/2013 | Golden, Jr. | A61G 5/02 | 280/304.1 |
| 8,678,402 | B2 * | 3/2014 | Helterbrand | A61G 5/10 | 280/250.1 |
| 8,764,047 | B2 * | 7/2014 | Daly | B62B 7/02 | 280/657 |
| 8,973,925 | B1 * | 3/2015 | Helterbrand | A61G 5/08 | 280/250.1 |
| 9,192,529 | B1 * | 11/2015 | Schlags | A61G 1/0237 | |
| 2005/0184478 | A1 * | 8/2005 | Ruedy | B62B 1/10 | 280/47.25 |
| 2007/0018443 | A1 * | 1/2007 | Wilmot | A61G 5/00 | 280/755 |
| 2007/0056106 | A1 * | 3/2007 | Roberts | A61G 1/0293 | 5/620 |

* cited by examiner

ALL-TERRAIN WHEELCHAIR

CROSS-REFERENCE TO RELATED APPLICATIONS

The present application claims priority of the U.S. Provisional Application 61/895,780 filed on Oct. 25, 2013 entitled "All-Terrain Wheelchair," the contents of which are hereby incorporated by reference.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention is in the technical field of wheelchairs. More particularly, the present invention is in the technical field of wheelchairs able to travel over a plurality of surfaces, both "on-road" and "off-road."

For the purposes of this application, wheelchairs can be broken down into two categories: motor-propelled and manually propelled. Motor-propelled wheelchairs feature a motor, electric or other, which provides the energy necessary to move the wheelchair around. Manually propelled wheelchairs rely on the user or another to provide the energy necessary to move the wheelchair. The present invention and the wheelchairs discussed in this application are human propelled.

Traditional wheelchairs date back to the 6th century C.E. China and have been refined over thousands of years. In general, traditional wheelchairs feature a seat, backrest, two armrests, two footrests, two large rear wheels and two small front caster wheels. In addition, traditional wheelchairs typically feature handles on the top left and top right corners of the seat so that another may push the wheelchair and user.

Traditional wheelchairs feature thin rear wheels of a large diameter, often 50 cm-60 cm in diameter. Two thin caster wheels of a much smaller diameter on the front of traditional wheelchairs allow the user or the person pushing the wheelchair to easily turn it as necessary. Taken together, the wheels and design of a traditional wheelchair provide the most-efficient means of travel possible, as long as the user is on solid ground and a relatively smooth surface.

Once a traditional wheelchair is taken off a paved surface, its deficiencies become readily apparent. The caster wheels on the front do not track in a straight line when the user moves a traditional wheelchair forward on sand or other soft surfaces. The thin nature of the front and rear wheels of a traditional wheelchair which make it so well-suited for paved surfaces make it poorly suited for unpaved surfaces.

Prior art discloses all terrain and beach wheelchairs encompassing a plurality of designs. The majority of wheelchairs in the prior art utilize designs similar to those of traditional wheelchairs, incorporating fatter, knobby tires similar to those on a mountain bike, or incorporate much wider front and rear wheels to provide floatation on softer surfaces, such as sand. All terrain wheelchairs currently on the market suffer from one or more of the following problems: difficult to push/pull; non-ergonomic pushing handles; difficulty of entry due to high tubing and low seat height; PVC frames which flex excessively and are not well constructed; and the likelihood of ejecting the passenger forward during abrupt stops.

The goal of the present invention is to remedy the deficiencies found in traditional wheelchairs and to offer an all terrain wheelchair superior to those on the market. The inventor believes the present invention offers a combination of novel features that, taken in combination, demonstrate a drastic improvement over the prior art.

The inventor has performed a search of the prior art and believes the present invention is a new and useful invention for which patent protection is warranted.

SUMMARY OF THE INVENTION

The present invention is an all-terrain wheelchair incorporating large wheels for ease of travel on non-paved surfaces, an easy-to-enter and comfortable seat, with ergonomic pushing and pulling handles in a frame, which is easily disassembled.

DETAILED DESCRIPTION OF THE INVENTION

The preferred embodiment of the present invention calls for a frame constructed of rigid, strong and lightweight materials, such as aluminum, stainless steel, plastic polymers, carbon fiber tubing, any variation thereof, or any other material suitable for the intended purposes of the present invention. The preferred embodiment of the present invention calls for the seat, backrest and footrest to be constructed of a material of sufficient strength to support the user's body comfortably. The preferred embodiment of the present invention calls for hollow pressurized wheels constructed of a durable material providing shock absorption, such as polyurethane, polyvinyl chloride or another suitable material.

Figure 1:
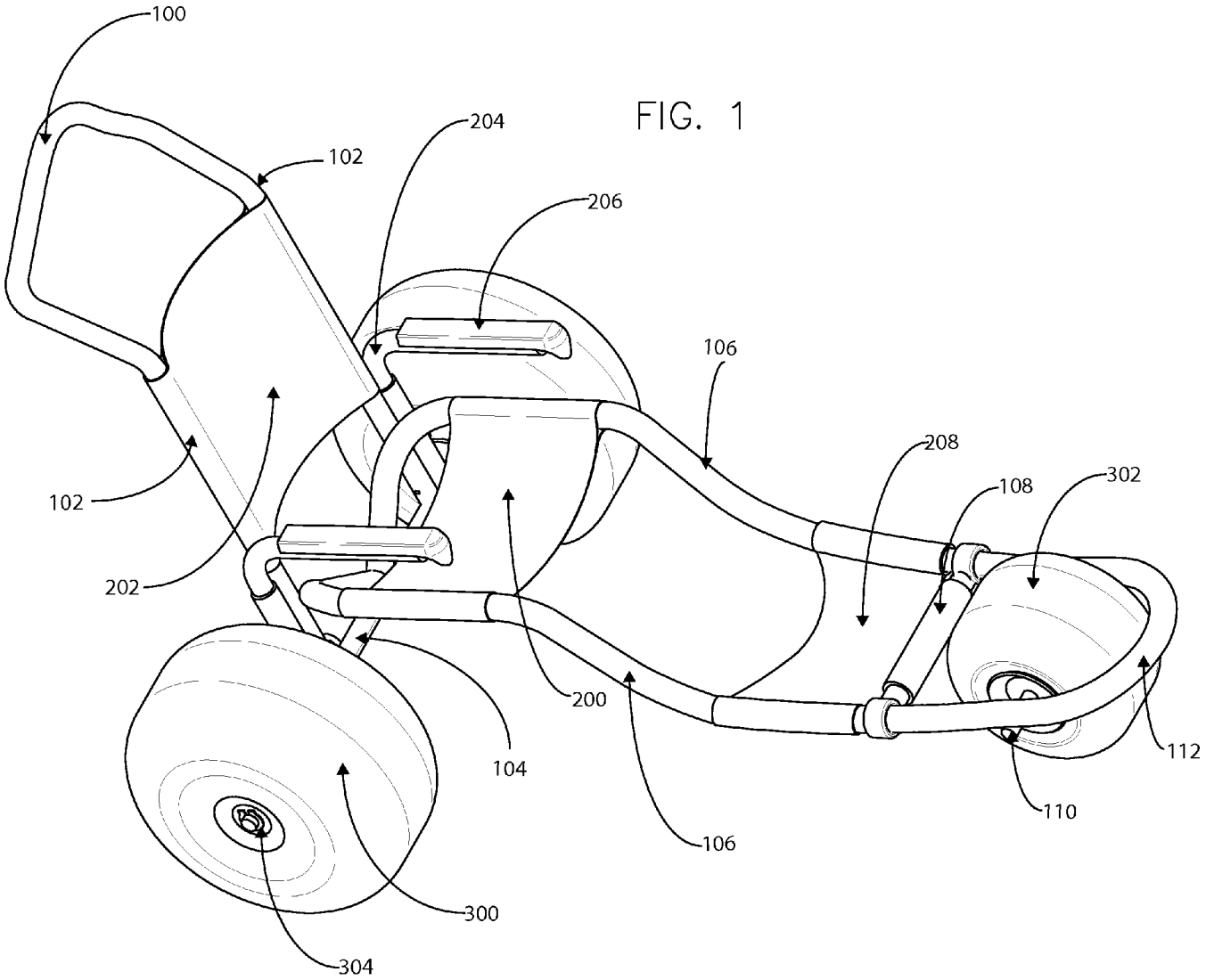
FIG. 1 is a perspective view of the present invention, taken from the front right side.

Referring now to the front perspective view of the present invention as shown in FIG. 1, there is shown the push handle 100, rear downtubes 102, rear axle 104, longitudinal support bars 106, front torsional support crossbrace 108, front axle 110 and front pull assembly 112. There is also shown the seat 200, backrest 202, armrest support tubes 204, armrest 206 and footrest 208. There is also shown the rear wheels 300, front wheel 302 and wheel retention bolts 304.

Figure 2:
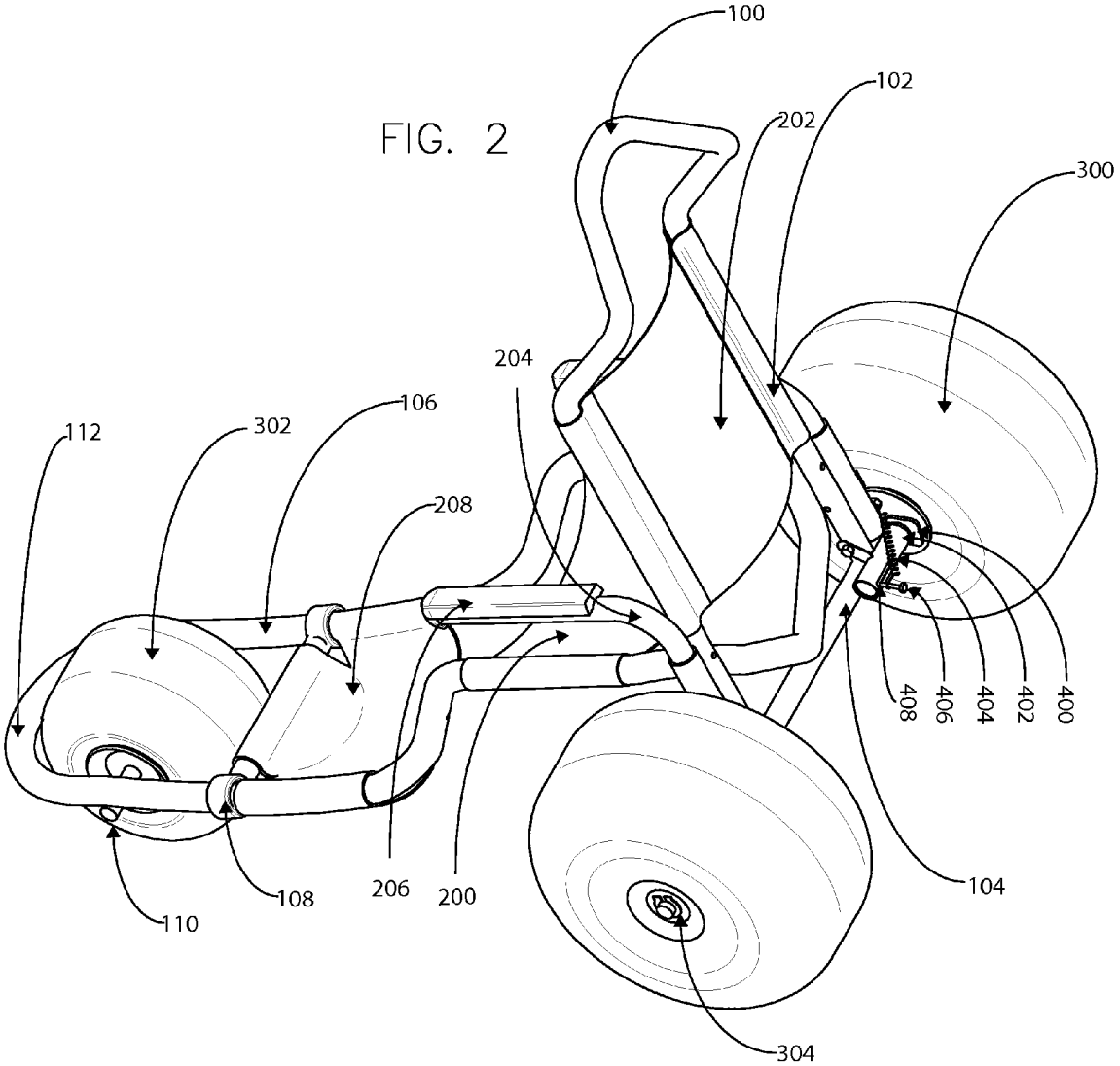
FIG. 2 is a perspective view of the present invention, taken from the back left side.

Referring now to the rear perspective view of the present invention as shown in FIG. 2, there is shown the push handle 100, rear downtubes 102, rear axle 104, longitudinal support bars 106, front torsional support crossbrace 108, front axle 110 and front pull assembly 112. There is also shown the seat 200, backrest 202, armrest support tubes 204, armrest 206 and footrest 208. There is also shown the rear wheels 300, front wheel 302 and wheel retention bolts 304. There is also shown the brake foot 400, brake foot sheath 402, brake spring 404, brake catch lever 406 and brake catch channel 408.

Figure 3:
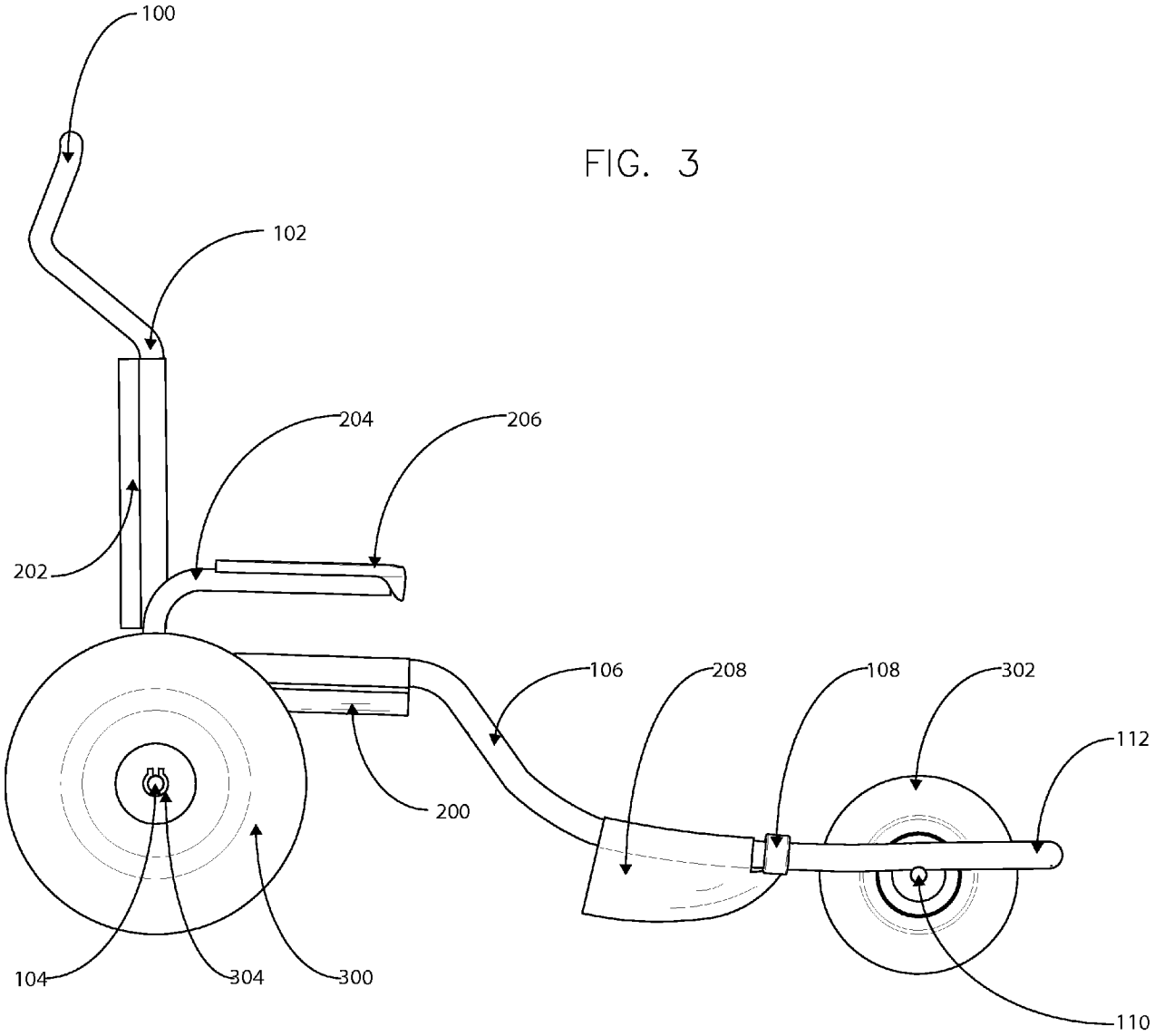
FIG. 3 is a side view of the present invention, showing the right side.

Referring now to the side view of the present invention as shown in FIG. 3, there is shown the push handle 100, rear downtubes 102, rear axle 104, longitudinal support bars 106, front torsional support crossbrace 108, front axle 110 and front pull assembly 112. There is also shown the seat 200, backrest 202, armrest support tubes 204, armrest 206 and footrest 208. There is also shown the rear wheels 300, front wheel 302 and wheel retention bolts 304.

Figure 4:
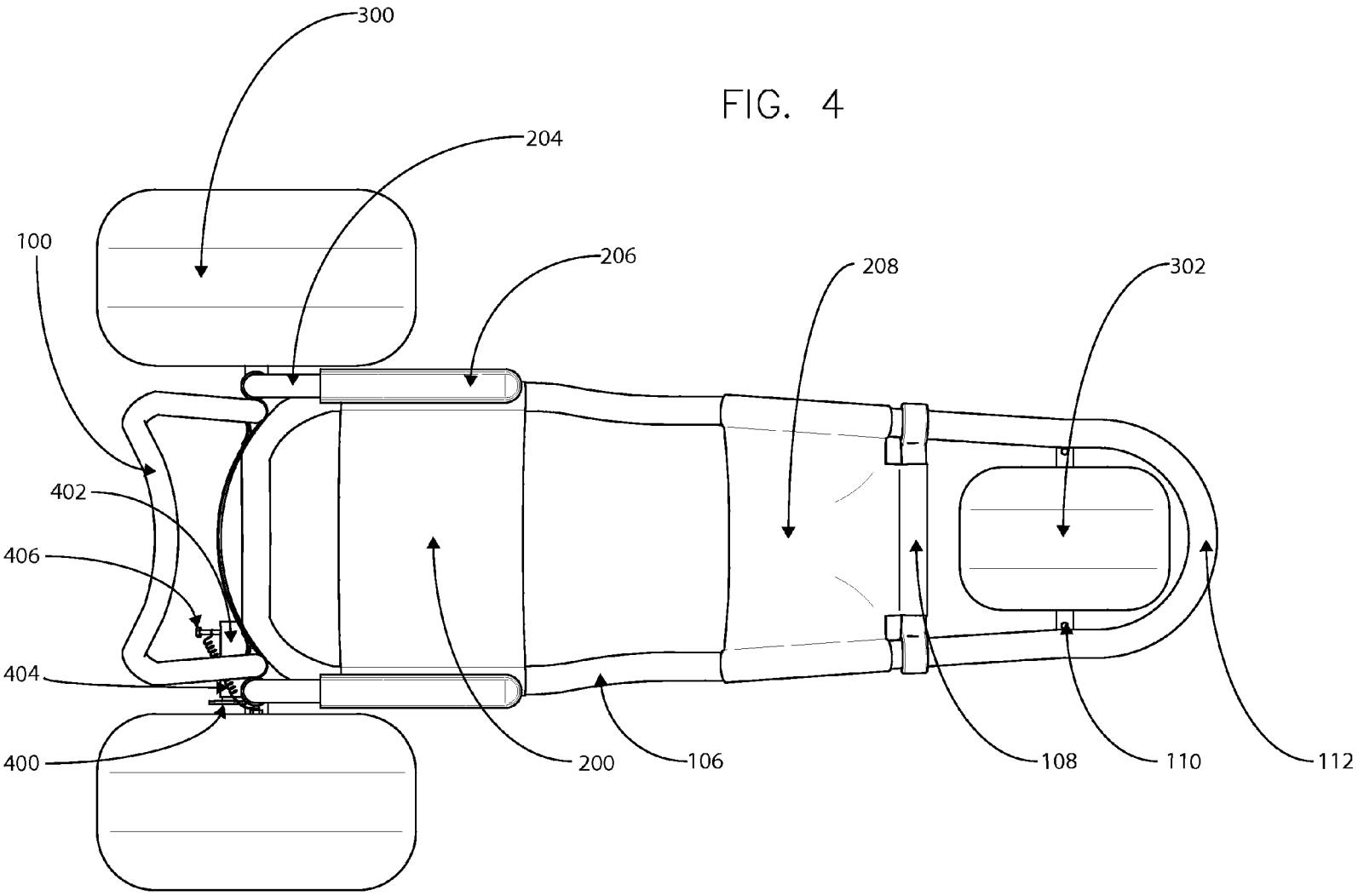
FIG. 4 is a top view of the present invention.

Referring now to the top view of the present invention as shown in FIG. 4, there is shown the push handle 100, longitudinal support bars 106, front torsional support crossbrace 108, front axle 110 and front pull assembly 112. There is also shown the seat 200, armrest support tubes 204, armrest 206 and footrest 208. There is also shown the rear wheels 300 and front wheel 302. There is also shown the brake foot 400, brake foot sheath 402, brake spring 404 and brake catch lever 406.

Figure 5:
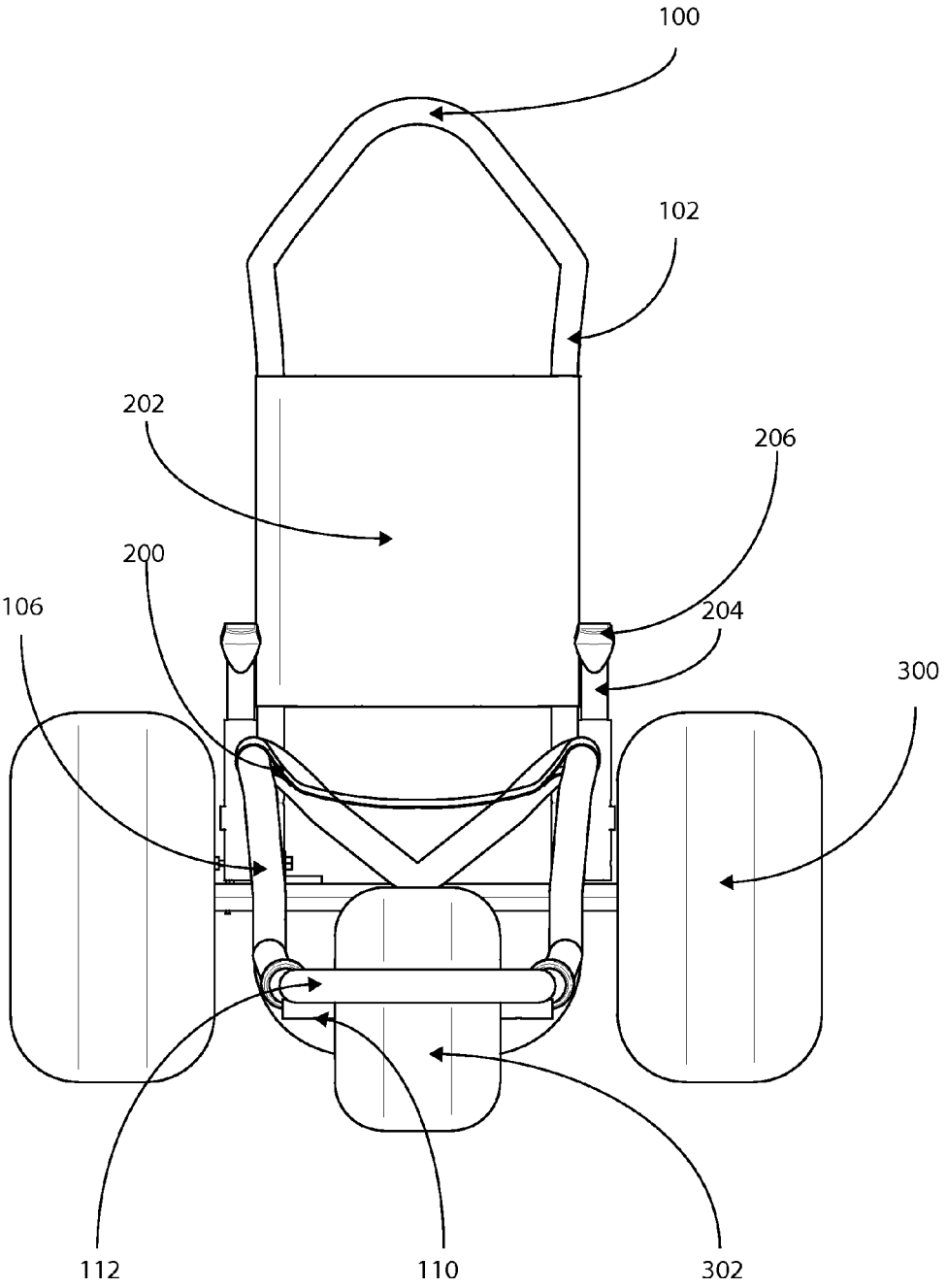
FIG. 5 is a front view of the present invention.

Referring now to the front view of the present invention as shown in FIG. 5, there is shown the push handle 100, rear downtubes 102, longitudinal support bars 106, front axle 110 and front pull assembly 112. There is also shown the seat 200, backrest 202, armrest support tubes 204, and armrest 206. There is also shown the rear wheels 300 and front wheel 302.

Figure 6:
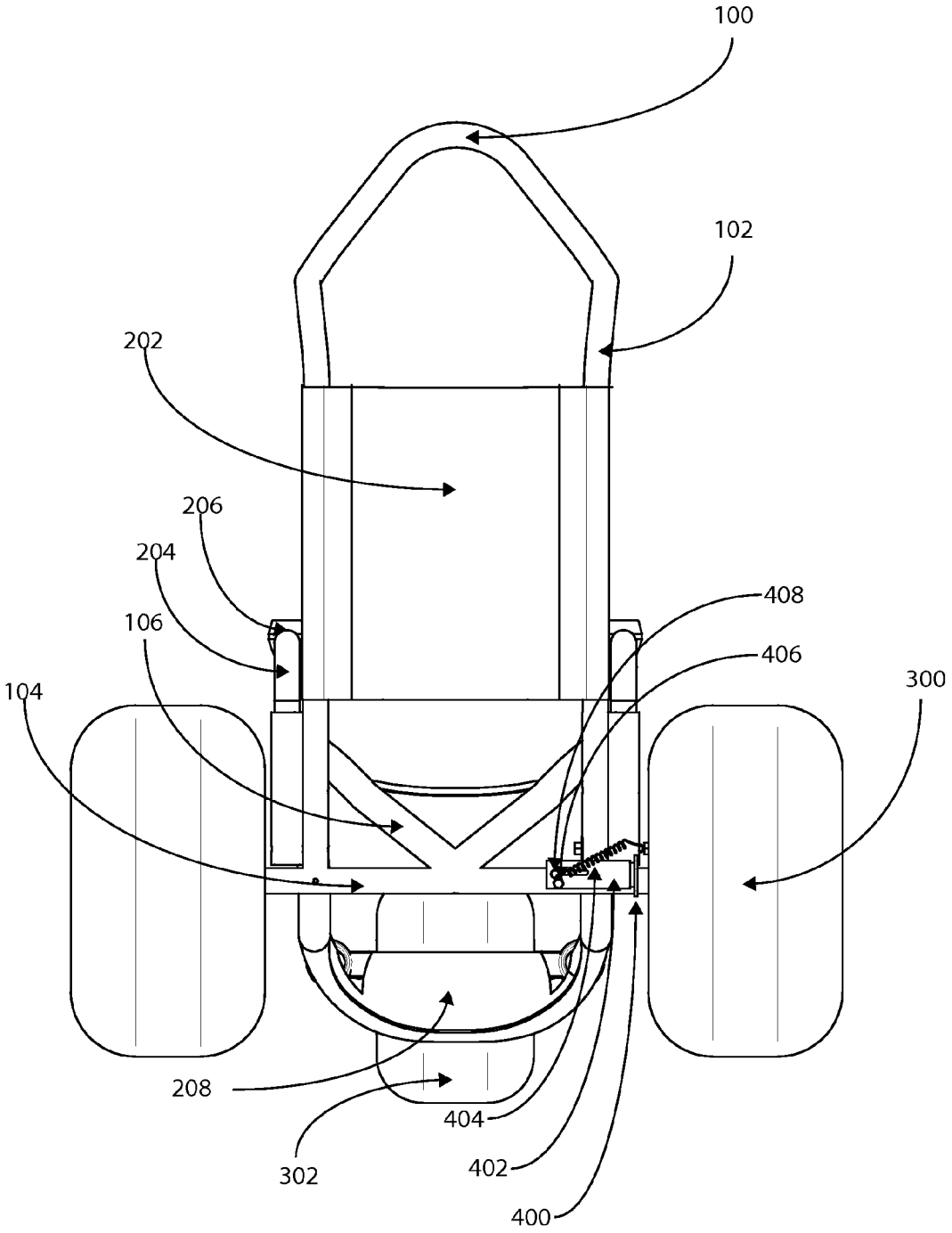
FIG. 6 is a rear view of the present invention.

Referring now to the rear view of the present invention as shown in FIG. 6, there is shown the push handle 100, rear downtubes 102, rear axle 104 and longitudinal support bars 106. There is also shown backrest 202, armrest support tubes 204, armrest 206 and footrest 208. There is also shown the rear wheels 300 and front wheel 302. There is also shown the brake foot 400, brake foot sheath 402, brake spring 404, brake catch lever 406 and brake catch channel 408.

Referring to the construction of the frame 100-112 as shown in all FIGS., the frame 100-112 is comprised of a plurality of mated tubes. The preferred embodiment utilizes thumbscrews to join the various parts of the frame assembly 100-112 so that the user may easily disassemble and reassemble as required. Alternative embodiments of the present invention may utilize nuts and bolts, posts/pins and clips or any other method that would securely the tubing of the frame assembly 100-112. The push handle 100 meets the rear downtubes 102 and continues down to the rear axle 104. The longitudinal support bars 106 meet in the center of the rear axle 104 and continue forward past the seat 200, footrest 208, front torsional support crossbrace 108, and front axle 110 to the front pull assembly 112.

One goal of the present invention is to allow the user to easily assemble and disassemble the wheelchair. Many users of the present invention will continue to use traditional wheelchairs for travel on paved surfaces, but desire a portable wheelchair when the user wishes to travel on non-paved surfaces, such as the beach. The preferred embodiment calls for the frame assembly 100-112 to be constructed of a plurality of tubing, which may be easily joined utilizing thumbscrews, or other suitable attachment mechanism. The preferred embodiment of the present invention calls for separate tubing and attachment points in the following general areas: on the armrest support tubes 204 behind the armrests 206; on the longitudinal support bars 106 roughly midway between the front edge of the seat 200 and the rear edge of the footrest 208; on the rear downtubes 102 and below the bottom edge of the backrest 202. Alternative embodiments of the present invention may utilize a different configuration of attachment points. The attachment points of the preferred embodiment of the present invention are placed in such a manner as to allow the user to stack the various portions of the present invention on each other when disassembled, allowing for storage in the most-compact manner possible.

To disassemble the frame assembly 100-112, the user removes the attachment mechanisms from the various attachment points and slides the corresponding portions of the frame 100-112 away from their mates. To reassemble the frame assembly 100-112, the user reverses the process.

Referring in more detail to the seat 200, backrest 202 and footrest 208 as shown in all Figs., the seat 200, backrest 202 and footrest 208 are all constructed in such a manner as to be easily removable from, and attached to, the frame assembly 100-112 of the wheelchair. The preferred embodiment of the present invention calls for the seat 200, backrest 202 and footrest 208 to be constructed so that the user may slide them onto the appropriate portions of the frame assembly 100-112. Alternative embodiments of the present invention allow for other attachment mechanisms, such as hook and loop, rivets, or any other mechanism that would securely hold each part in place on the frame assembly 100-112, while allowing quick disassembly and reassembly.

Referring in more detail to the rear wheels 300 and their attachment to the frame assembly 100-112 as shown in the FIGS., the rear wheels 300 are designed to slide over the terminals of the rear axle 104 and remain securely in place as long as the wheel retention bolts 304 are fastened to the terminals of the rear axle 104. Removing the wheel retention bolts 304 allows the user to slide the rear wheels 300 off either terminal of the rear axle 104. To reattach the rear wheels 300, the user slides the rear wheels 300 onto the terminals of the rear axle 104 and screws the wheel retention bolts 304 in place. Alternative embodiments of the present invention may use different securement mechanisms, such as retention clips, to retain the rear wheels 300 than the wheel retention bolts 304 referenced in the drawings.

The preferred embodiment of the present invention features a brake mechanism as shown in FIGS. 2, 4 and 6. The brake mechanism features a brake foot 400, brake foot sheath 402, brake spring 404 and brake catch lever 406, which is further enclosed in a brake catch channel 408. The brake foot 400 is designed to slide horizontally within the brake foot sheath 402. At the internal end of the brake foot 400, there is found a brake catch lever 406, which hooks into a catch in the brake catch channel 408, when it is desirable to have the brake disengaged and the wheelchair move freely. A brake spring 404 runs between the brake catch lever 406 and its outer attachment point on one of the armrest support tubes 204. When the user wishes to engage the brake, he slides the brake catch lever 406 upwards and away from the catch in the brake catch channel 408, at which point, the brake spring 404 pulls the brake catch lever 406, and consequently the brake foot 400, outward toward the rear wheel 300, locking the brake foot 400 against a bolt within the rear wheel 300 or into a channel within the rear wheel 300.

To use the wheelchair, the user is placed onto the seat 200, where he may rest comfortably with his back on the backrest 202 and his arms on the armrests 206. If desired, the user may push forward on the rear wheels 300 to propel the wheelchair forward. The larger rear wheels 300 and front wheel 302 found on the present invention allow him to travel over both hard and soft surfaces with ease.

The present invention is designed in such a way that another may push or pull the user over hard and soft surfaces with ease. The push handle 100 is ergonomically designed to provide the most optimal transfer of energy from the assistant to the wheelchair so that the assistant may push it for long distances without tiring. Furthermore, the front pull assembly 112 allows an assistant to lift the front of the wheelchair and easily pull the user if so desired. The overall design of the frame 100-112 and placement of the seat 200 and backrest 202 in relation to the rear axle 104 and rear wheels 300 keeps the users weight centered over the rear wheels 300 so the assistant may pull the chair without his arms quickly tiring.

The present invention is designed to fit users of a variety of heights. The front torsional support crossbrace 108 features clamps on the ends where it attaches to the longitudinal support bars 106. The front torsional support crossbrace 108 comprises two pieces of tubing, one within the other. To adjust the position of the front torsional support crossbrace 108 on the longitudinal support bars 106, and consequently the placement of the footrest 208, the user loosens the clamps on the front torsional support crossbrace 108 and moves it about the longitudinal support bars 106 to the position most comfortable to him. Furthermore, the front torsional support crossbrace 108 may feature padding where it meets the footrest 208 for comfort.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

We claim:

1. A wheelchair comprising:

a single frame comprising a plurality of interconnected hollow tubes of rigid and lightweight material, said tubing forming at least a left portion, a right portion, a fore portion, an aft portion, a front axle, at least one rear axle, one upwardly-angled pushing handle continuously connected to said aft portion at the left portion of the frame and the right portion of the frame, a pulling handle at the fore portion of the frame and at least one crossbrace located proximate to said fore portion and sandwiched between the left portion of the frame and the right portion of the frame;

a set of wheels, said set consisting of two rear wheels of a width allowing smooth rotation over non-paved surfaces rotationally mounted aft the seat at the aft portion of the frame on at least one rear axle and one front wheel of a width allowing smooth rotation over non-paved surfaces rotationally mounted at the fore portion of the frame on a front axle and equidistant between the left portion of the frame and the right portion of the frame;

a seating surface sandwiched between and supported by the left portion of the frame and the right portion of the frame and near the aft portion of the frame;

a footrest separate from the seating surface, sandwiched between and supported by the left portion of the frame, the right portion of the frame and the crossbrace, said footrest located aft the front wheel and at an elevation below the seating surface;

a backrest separate from the seating surface, sandwiched between and supported by the left portion of the frame and the right portion of the frame and at an elevation above the seating surface.

2. The wheelchair as defined in claim 1 wherein the footrest, seat and backrest comprise a lightweight and flexible material.

3. The wheelchair as defined in claim 1 wherein a plurality of attachment points along the frame allow the user to disassemble and reassemble the frame.

4. The wheelchair as defined in claim 1 wherein the bases of a single pushing handle are attached to the frame behind the seat and angled upward for pushing of the wheelchair by a person other than the user of the wheelchair.

5. The wheelchair as defined in claim 1 with a wheel locking apparatus at the aft portion of the frame along an axle, said wheel locking apparatus capable of locking at least one rear wheel in place, preventing forward or backward travel of the wheelchair without the use of actuation levers, brake discs or calipers.

6. The wheelchair as defined in claim 1 with armrests separate from, and removable attached to, the frame at a locus proximate to the seat and backrest.

* * * * *